US005152223A

United States Patent [19]

Mairon

[11] Patent Number: 5,152,223

[45] Date of Patent: Oct. 6, 1992

[54] AUTOMATIC RUBBER STAMP

[75] Inventor: Omri Mairon, Kibbutz Ruchama, Israel

[73] Assignee: "Hamivreshet" Brush Factory Kibbutz Ruchama 1973, Israel

[21] Appl. No.: 508,270

[22] Filed: Apr. 11, 1990

[30] Foreign Application Priority Data

Apr. 16, 1989 [IL] Israel ..... 89972

[51] Int. Cl.[5] ..... B41K 1/42

[52] U.S. Cl. ..... 101/334; 101/104

[58] Field of Search ..... 101/333, 334, 104, 105

[56] References Cited

U.S. PATENT DOCUMENTS

| | | | |
|---|---|---|---|
| 2,312,727 | 3/1943 | Nisenson | 101/334 |
| 3,251,299 | 5/1966 | Duke et al. | 101/105 X |
| 4,432,281 | 2/1984 | Wall et al. | 101/334 |

FOREIGN PATENT DOCUMENTS

| | | | |
|---|---|---|---|
| 232014 | 2/1964 | Austria | 101/334 |

*Primary Examiner*—Edgar S. Burr
*Assistant Examiner*—Christopher Bennett
*Attorney, Agent, or Firm*—Ostrolenk, Faber, Gerb & Soffen

[57] ABSTRACT

An automatic self-inking, rubber-stamp device comprising a housing, ink pad, stamp plate and spring-loaded actuator. The device incorporates a guide pin integrally formed on the stamp plate and a cam formed on the housing wall which when the actuator is pressed down all act in coordination to turn the stamp plate over, from its resting position against the ink pad, to be pressed against the subject document. The device is further characterized by use of fewer components than in other products of the art, by its simplicity of construction and by its snap-together assembly thereby making it particularly suitable for automated and robotic assembly processes.

7 Claims, 5 Drawing Sheets

150
114

154
152
118
156'
116
156
124
112
138
122
170'
176
170
174
120
180
178

AUTOMATIC RUBBER STAMP

BACKGROUND OF THE INVENTION

The present invention relates to automatic rubber stamps of the type comprising a housing and incorporating therein an ink pad compartment, spring-loaded actuator member slidably mounted on the housing held by the spring in an upper position relative to the housing, a rubber stamp support plate pivotably mounted within the housing, and an over-turning mechanism coupled to the stamp plate in such a manner that when the stamp actuator is displaced downwards, while the housing is placed on a document to be stamped, the stamp plate is carried from an upper, face-up position, where it is constantly pressed against the ink pad, to a face-down position where it becomes pressed against the document to apply the stamp. Such automatic, self-inking rubber stamp devices are well known and need not be further described.

Numerous disadvantages have been recognized and remain unresolved in conventional devices. First, their production costs are necessarily high since they are composed of at least eight components, each separately manufactured and then assembled into the complete device. These parts include the housing; the stamp actuator; the counter spring; the ink pad; the rubber stamp support plate; a pair of ear-like slotted pivotable members which take part in overturning the stamp plate following the pressing down of the stamp actuator; and an elongated pivot rod inserted from one to the opposite side wall of the housing, constituting the translational pivot axle of the stamp plate.

Secondly, and as a direct outcome of this structure, the assembly of the device is rather complicated. In any event, automated assembly operations, employing robotics, is ruled out, mainly, since during the positioning stage of the pivotable members and insertion from the side of the elongated pivot axle, the remaining components must be held in an intermediate position against resistance provided by the counter spring.

It is thus the prime object of the invention to produce an automatic stamping device composed of fewer components.

It is a further object of the invention to adapt the assembly of the device to a fully automated, robot based, operation.

It is a still further object of the invention that complete assembly of the device can be effected by simple, "snap-in" operations.

SUMMARY OF THE INVENTION

According to the invention there is provided an automatic, self-inking rubber stamp device. The device comprises a housing having two, opposite, slotted side walls, an open planar bottom, an ink pad compartment, an ink pad received within the compartment with its pad facing the open bottom, and an upwards spring urged stamping actuator of a generally U-shape configuration. The actuator is associated with the housing such that downward displacement of the actuator effects the stamping operation of the device. The device further comprises a rubber stamp carrier plate coupled to the stamping actuator by a pair of pivot pins such that when the device is in its resting position the plate faces and abuts against the ink pad, and that during downward displacement of the actuator the plate is turned over into a face-down position and pushed flush with the planar bottom. The stamp carrier plate is provided with at least one, integrally formed projecting guide pin extending parallel to and above its respective pivot pin. The respective side wall of the housing is provided with a cam surface adapted to co-operate with the guide pin and with a flat surface portion of the stamp plate to effect the over-turning of the plate during the downward displacement of the stamp actuator.

The cam surface is of a generally M-shape configuration, integrally formed and projecting from the inner surface of the one side wall of the housing.

The guide as well as the pivot pins may be integrally formed with the stamp plate.

The pivot pins are retained in sockets which are preferably formed in a manner allowing insertion of the pins thereinto through an open side of the slots, by a "snap-in" action whereby the legs of the actuator are first flexibly spread-away from each other and then closed one against the other.

Alternatively, a pivot pin rod is used.

BRIEF DESCRIPTION OF THE DRAWINGS

These and further constructional details and advantages of the invention will become more fully understood and appreciated in the light of the ensuing description of two preferred embodiments of the invention, given by way of example only, with reference to the accompanying drawings wherein.

FIGS. *7a–7f* illustrate consecutive operational stages of the device according to the described embodiment of the invention.

DETAILED DESCRIPTION OF THE PREFERRED EMBODIMENTS

Figure 1:
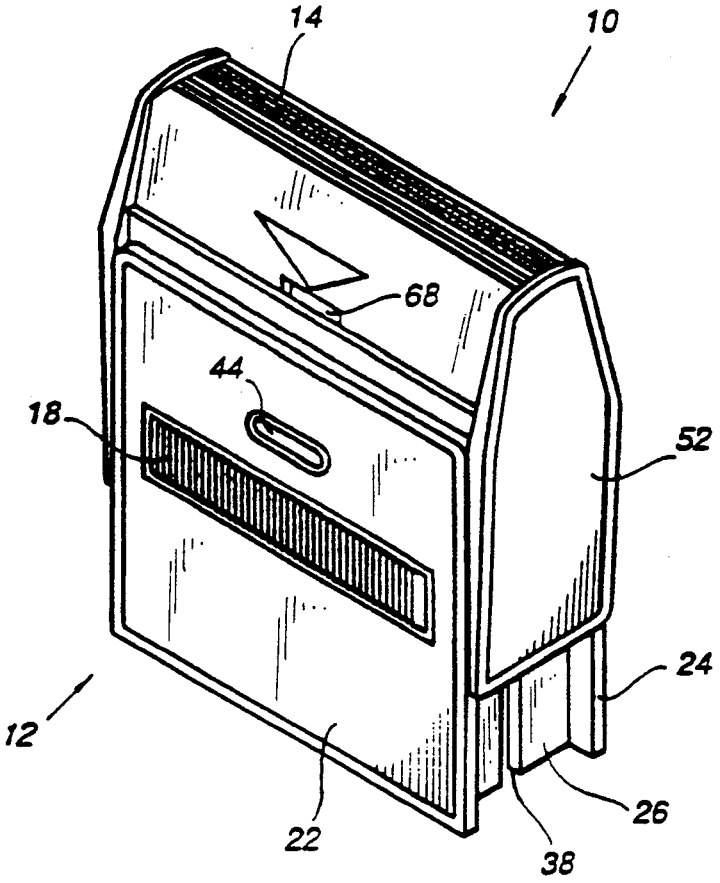
FIG. 1 is a general, three-dimensional view of an automatic stamping device according to a first embodiment of the invention.
Figure 2:
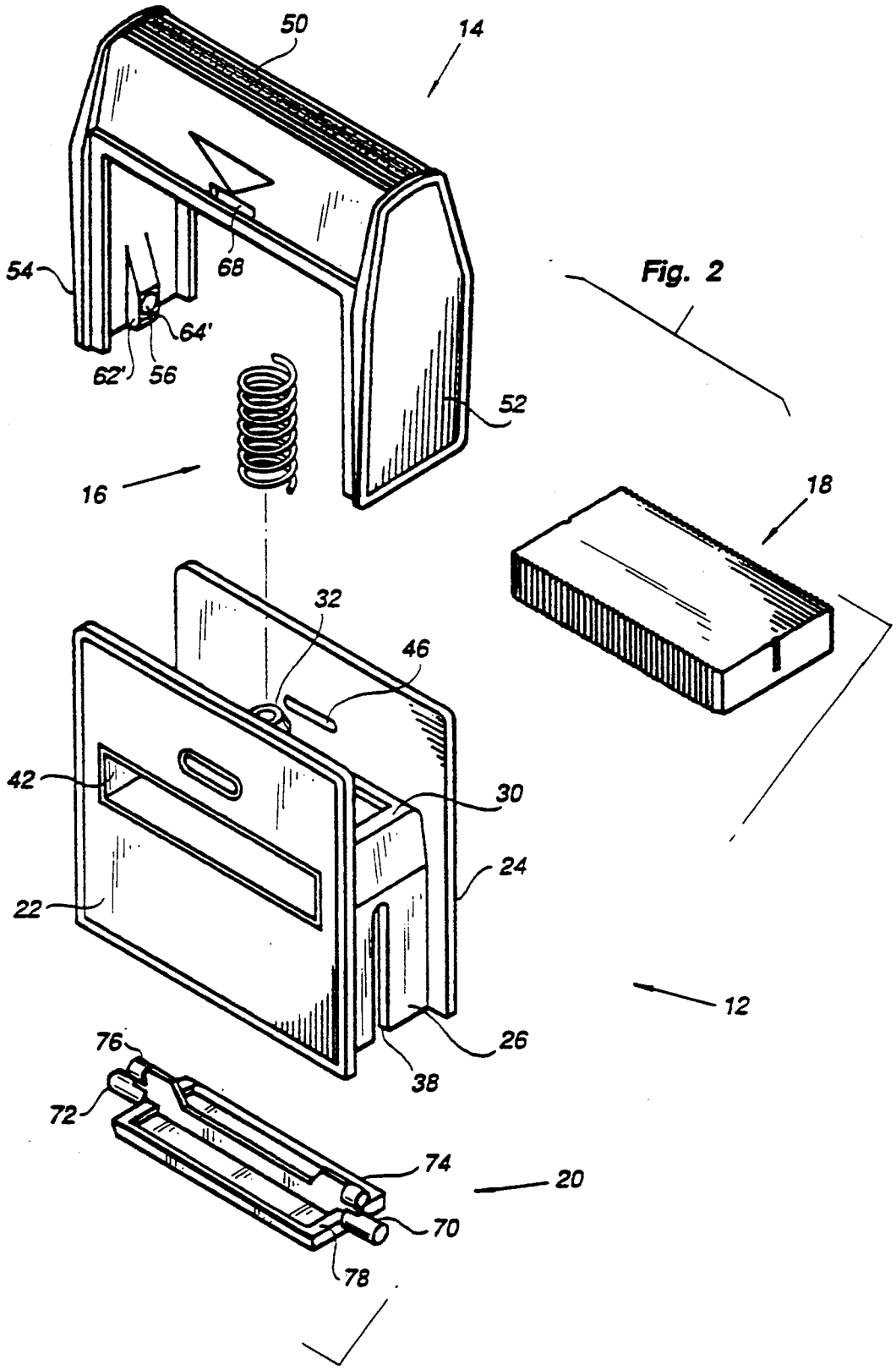
FIG. 2 is a three-dimensional, exploded view of the device of FIG. 1.

As shown in FIG. 1, and more clearly in FIG. 2, the automatic stamping device denoted 10 is composed of only five parts: Housing 12, actuator 14, coil spring 16, ink pad 18 and rubber stamp support plate 20. Particular notice should be given to the fact that the outer appearance and mode of operation remain unchanged compared with conventional devices.

Figure 3:
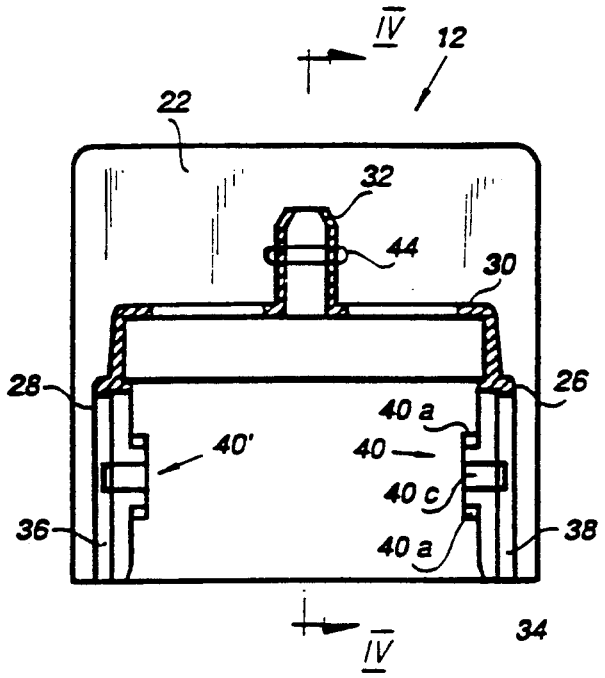
FIG. 3 is a longitudinal cross-section of the housing member of the device.
Figure 4:
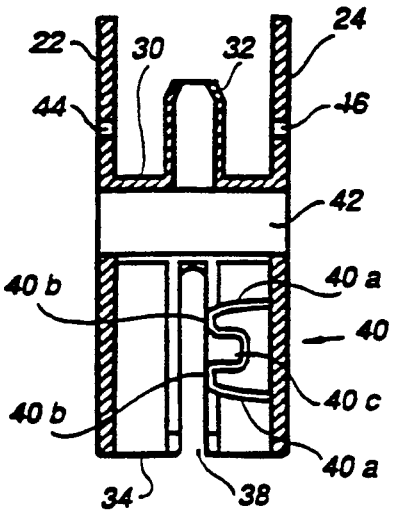
FIG. 4 is a section taken along lines IV—IV of FIG. 3.

As seen in FIGS. 3 and 4, the housing 12 is comprised of front and rear planar walls 22 and 24, two side walls 26 and 28, and a partly open top wall 30 which is formed with an upward extending projection 32 for the support of the coil spring 16.

The coil spring may be substituted by a zig-zag shaped spring more easily handled by automatic feeding devices.

The housing defines an open bottom 34 through which the stamping operation by the stamp plate 20 takes place.

Both side walls are provided with an elongated, straight upwardly extending slots 36 and 38. In contrast to the design of conventional devices, the two slots 36 and 38 are open at their lower side, namely flush with the bottom plane 34.

At the inner side of at least one of the side walls, a cam surface, denoted 40, is formed, generally configured as the letter "E" or "M" (rotated by 90 degrees). In greater detail, the cam is composed of first and second curved side surfaces 40*a*, a pair of straight surfaces 40*b* extending parallel to and flush with one side of the respective slot (38 in FIG. 4), and a U-shaped surface 40*c* interconnecting the surfaces 40*b*. The cam surface 40' at the opposite wall 28 is a mirror-image of the first surface 40.

The housing further comprises a transversely extending compartment 42 designed to accommodate the ink pad 18, as well as opposite openings 44 and 46 which are used when the pad is to be replaced—all as in conventional devices.

Figure 5:
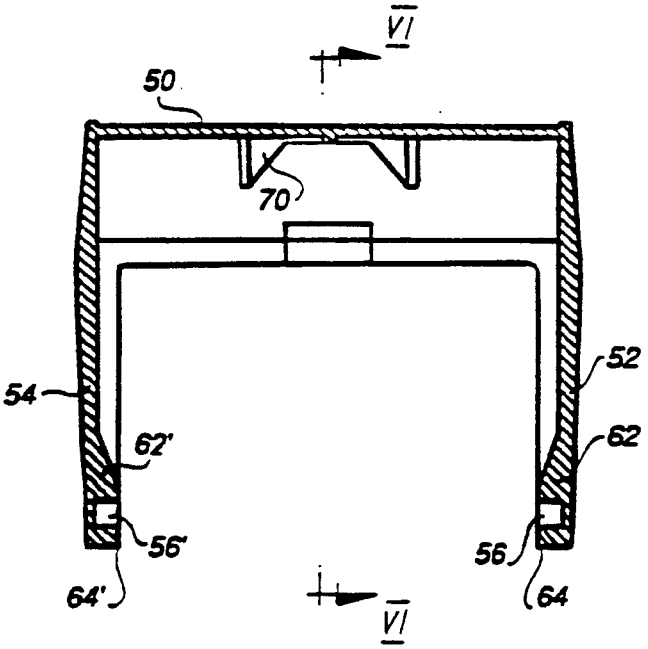
FIG. 5 is a longitudinal cross-section of the actuator member.
Figure 6:
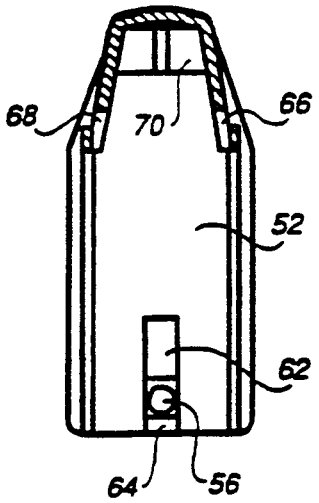
FIG. 6 is a section taken along lines VI—VI of FIG. 5.
Figure 7A:
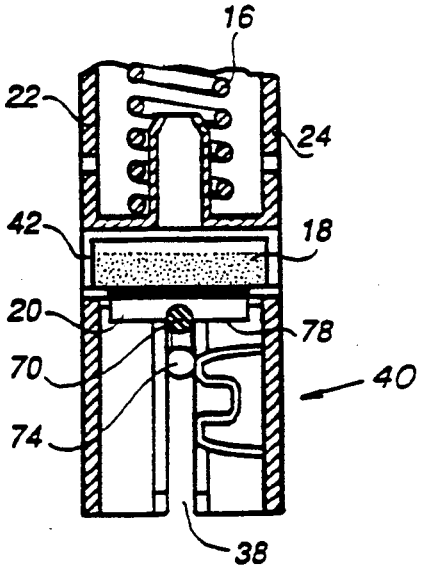
Figure 7D:
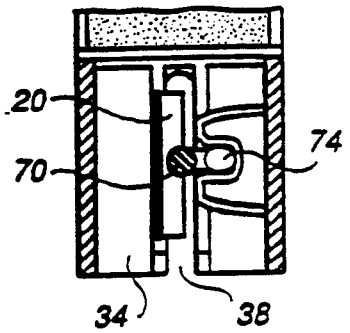
Figure 7B:
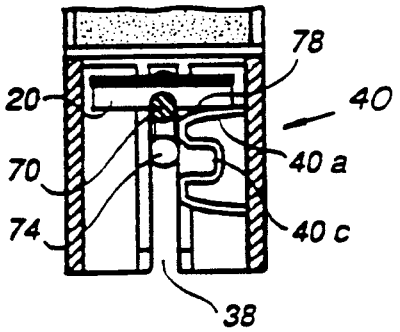
Figure 7E:
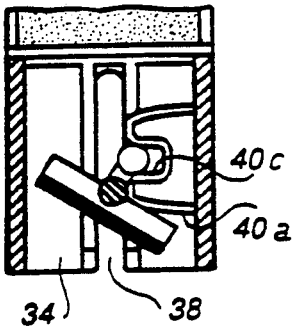
Figure 7C:
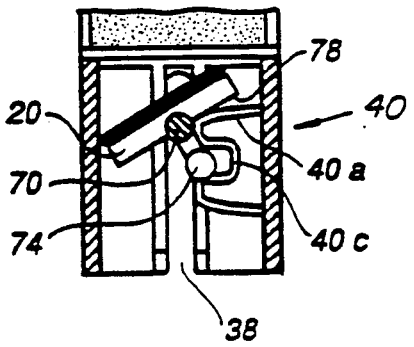
Figure 7F:
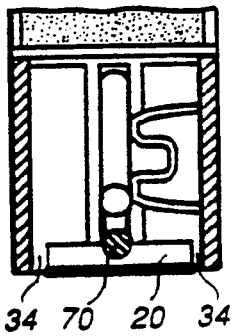

Referring now to FIGS. 5 and 6, the actuator member 14 is generally U-shaped having a web portion 50 and legs 52 and 54, each provided with a pivot pin support socket 56, 56' the function and operation of which will be described later on. The sockets 56 are integrally formed within bulging portions 62 and 62' formed towards the free end of the legs 52 and 54, respectively. The bulging portions 62, 62' are each provided with a facet 64 defining a tapering slide surface to facilitate "snap-in" assembly operation as will be described further below. Elongated slots 66 and 68 are provided in a manner similar to that of the conventional devices, namely for cooperating with the slots 44 and 46 in the stamp housing 12 for locking the actuator against the housing when replacement of the ink pad is required.

Finally, a spring socket 70 is provided at the inner side of the top wall 50 of the actuator member 14, to avoid dislocation of the coil spring 16.

Rubber stamp support plate 20 (see FIG. 2) comprises, extending oppositely from both sides thereof, pivot pins 70 and 72 at a level somewhat higher than the bottom level of the plate (to which the rubber stamping strip is bonded). At a further higher level, a pair of guide pins 74 and 76 are provided extending parallel to and being somewhat shorter than the pivot pins 70 and 72. As will become apparent from the description given below, only one such guide pin is actually necessary.

The assembly mode and operation of the device heretofore described will now be explained. As readily understood from the relative positions of the stamp device components shown in the exploded view of FIG. 2, assembly of the device involves the positioning of the housing 12 above stamp plate 20 so that the pivot pins are partly inserted into their respective slots through the open bottom thereof; placing the coil spring 16 onto its support projection 32; and simply sliding the actuator member 14 downwards, until pivot pins 70 and 72 snap in to their respective sockets 56 and 56'. This "snap-in" action is enhanced by the provision of facets 64 as already mentioned.

Operation of the device is clearly illustrated in the series of operating stages shown in FIGS. *7a–7f* (following assembly of the device, ink pad 18 is situated in its compartment 42, and plate 20 is held, face-up, against the ink pad, by spring 16).

When the actuator 14 starts to move downwards, the pivot pins 70 and 72 are carried down, to lower the plate 20 in a still upward facing position until its cam surface 78 engages and starts to roll over the upper curved cam surface 40*a*. Further downward displacement of the pivot pins 70 (72) will cause rotation of the plate 20 in a counter-clockwise direction, further causing the guide pin 74 (and 76—if provided) to enter the U-shaped cam surface section 40*c* as shown in FIG. *7c*. The guided movement of the plate 20 is thus supported simultaneously by the guide pin or pins and the upper plate surface, causing translational movement of plate 20 about the cam surfaces 40*a* and 40*b* until a complete turned-over position is attained (see FIG. *7f*) and the remaining downward displacement of the actuator member 14 will bring the plate 20 down to the level of the housing bottom 34 where a stamping operation will be effected.

The reverse order of translational movement will occur when the actuator 14 is relieved and moves upwards following relief of compression of spring 16 until the initial resting position as depicted in FIG. *7a* is again attained.

The unique and outstanding advantages of the device, in relation to its structure and method of assembly should now be apparent. The lesser number of parts and simplicity of assembly significantly contribute to a reduction in manufacturing and assembly processing costs on the one hand, as well as to enhanced reliability and durability of the device, on the other hand.

Figure 8:
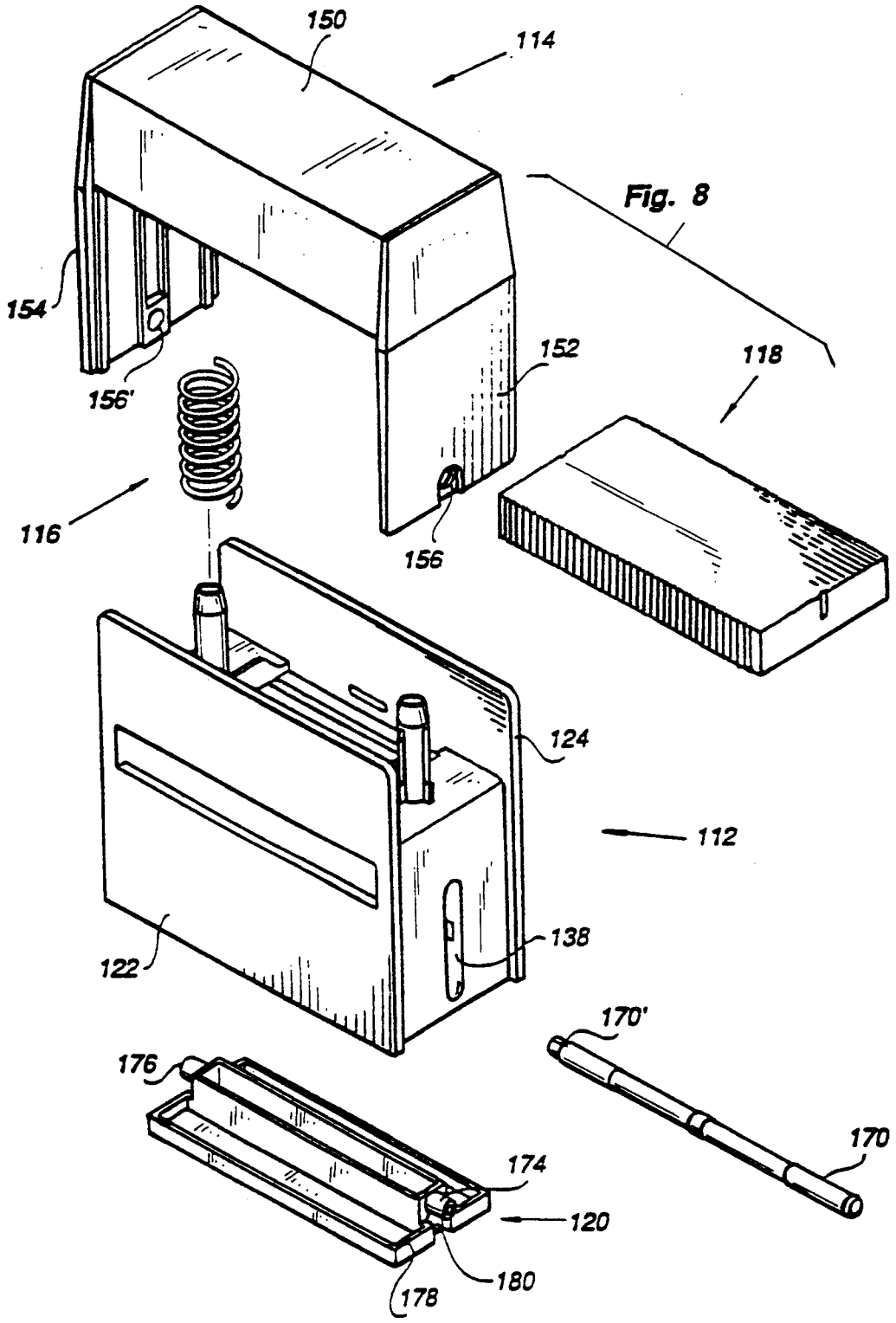
FIG. 8 is a three-dimensional, exploded view of a device according to a further embodiment of the invention.

The modified, second embodiment of the invention, as illustrated in FIG. 8 (where similar reference numerals are used but prefaced by the numeral 1), is specifically applicable to large-size stamp devices. The problem with the larger devices is that the rigidity of legs 152 and 154 having sockets 156 and 156' of actuator member 114 is not sufficient to assure safe holding of the snapped-in pivot pins—as in the former embodiment.

Hence, while in all other respects the general structural features remain unchanged (housing 112, web portion 150, ink pad 118, walls 122 and 124, guide pins 174 and 176, cam surface 178), use is made of a separate pivot pin rod denoted 170—rather than the pair of pins 70 and 72 integrally formed as a part of plate 20. Pin 170 is inserted through opening 156 at the base of leg 152 of the actuator member 114, passing through slot 138 (which is closed at its bottom), and further passing through opening 180 at one side of the plate 120, below the guide pin 174, and then through the respective openings and slot located at the other side of the actuator, plate and housing wall (not shown).

A springy, split shank portion 170' is provided at the leading end of the pin 170 for self-locking of the pin once engaged at opening 156'.

While this structure is composed of one, additional component (besides an additional, optional, coil spring 116), it is still feasible to employ a fully automated assembly process, due to the absence of other, discrete parts incorporated into the conventional design.

The operation of the device is the same as described above with reference to FIG. 7.

Those skilled in the art will readily appreciate that various changes, modifications and variations may be applied to the invention as hereinabove exemplified without departing from the scope of the invention as defined in and by the appended claims.

What is claimed is:

1. An automatic, self-inking rubber stamp device comprising:

(i) a housing having two, opposite side walls, an open planar bottom, and an ink pad compartment, the side walls each having an open-ended guide slot reaching down and open to the open planar bottom, the side walls having outer and inner sides;

(ii) an ink pad received within the compartment, the ink pad facing downwardly toward the open bottom;

(iii) a stamping actuator and a spring, the spring disposed between the actuator and housing, the stamping actuator upwardly urged by the spring and the actuator having two legs each extending alongside a respective outer side of the housing side walls, said legs including means for displaceably mounting said actuator to the housing between an upper resting position and a lower stamping position;

(iv) each leg having a free end and having near the free end a respective depression;

(v) a rubber stamp carrier plate having a flat bottom surface portion and a cam surface portion on a surface opposite the bottom surface portion, the plate having an end adjacent each side wall of the housing and having a pivot pin at each end, the plate being coupled pivotally in the depressions in the stamping actuator by the pivot pins, the pivot pins being integrally formed with the plate and extending through the housing side wall slots, said plate being disposed such that when the actuator is in its resting position the plate bottom portion faces upwardly and abuts against the ink pad, and during downward displacement of the actuator, the plate is turned over into a face-down position with the bottom portion facing downwardly and pushed toward said planar bottom so that a stamping operation can be performed;

(vi) said plate having at least one projecting guide pin integrally formed with the plate, extending parallel to and adjacent a respective pivot pin; and (vii) at least one cam surface extending from an inner side of at least one of the side walls of the housing adapted to co-operate with the at least one guide pin and with the cam surface portion of the plate to effect the overturning of the plate during the downward displacement of the stamp actuator, said plate being insertable into said open planar bottom of said housing with said bottom surface of the plate facing away from the open planar bottom and with the pivot pins inserted into said open ended guide slots at the open planar bottom with said actuator in said stamping position, said legs of said actuator being flexible so that with said actuator in said stamping position, said pivot pins flex said legs and snap into said depressions, thereby facilitating assembly of the plate in the device.

2. The device as claimed in claim 1, wherein the cam surface has upper and lower curved friction surfaces and an open sided concavity between the friction surfaces configured to receive the guide pin during the turning over of the plate.

3. The device as claimed in claim 2, wherein a pair of said guide pins and a pair of said cam surfaces are provided, in opposite, mirror-imaged relative position.

4. The device as claimed in claim 3, wherein the actuator legs each have a bulging portion integrally formed in the legs at the free ends, the pivot pin supporting depressions being formed within the bulging portions.

5. The device as claimed in claim 8, wherein the bulging portions each have a facet directed toward the free end of the respective leg for facilitating snapping-in of a respective pivot pin in a respective depression.

6. The device as claimed in claim 2 wherein the pivot pins are constituted by the two free ends of an elongated rod.

7. The device as claimed in claim 6 wherein the rod is carried by the stamp plate and is passed through respective guide slots.

* * * * *